US012571201B2

(12) United States Patent
Wheeler

(10) Patent No.: US 12,571,201 B2
(45) Date of Patent: Mar. 10, 2026

(54) CONCRETE-FILLABLE PREFABRICATED CARTRIDGES FOR CONSTRUCTING STRUCTURAL CONCRETE BUILDINGS AND CONSTRUCTION METHODS THEREFOR

(71) Applicant: İHAUS MODULAR, LLC, Blacksburg, VA (US)

(72) Inventor: Joseph Henry Wheeler, Blacksburg, VA (US)

(73) Assignee: iHAUS Modular, LLC, Blacksburg, VA (US)

( * ) Notice: Subject to any disclaimer, the term of this patent is extended or adjusted under 35 U.S.C. 154(b) by 180 days.

(21) Appl. No.: 18/339,450

(22) Filed: Jun. 22, 2023

(65) Prior Publication Data

US 2023/0417044 A1 Dec. 28, 2023

Related U.S. Application Data

(60) Provisional application No. 63/354,546, filed on Jun. 22, 2022.

(51) Int. Cl.

*E04B 1/348* (2006.01)
*E04B 1/66* (2006.01)
*E04B 2/84* (2006.01)

(52) U.S. Cl.

CPC ..... *E04B 1/34807* (2013.01); *E04B 1/665* (2013.01); *E04B 2/84* (2013.01)

(58) Field of Classification Search

CPC ..... E04B 1/161; E04B 1/165; E04B 2/8635; E04B 2/84; E04C 2/06; E04C 2/288; E04C 2/46

See application file for complete search history.

(56) References Cited

U.S. PATENT DOCUMENTS

| | | | | |
|---|---|---|---|---|
| 4,472,919 | A * | 9/1984 | Nourse | E04C 2/06 52/344 |
| 5,678,371 | A * | 10/1997 | Wills | E04B 1/0007 52/407.3 |
| 6,427,406 | B1 * | 8/2002 | Weaver | E04C 3/36 52/855 |
| 9,856,639 | B2 * | 1/2018 | Koszo | E04B 1/165 |
| 11,352,787 | B2 * | 6/2022 | Amend | E04B 2/8647 |
| 11,965,330 | B2 * | 4/2024 | Bond | E04B 2/845 |
| 12,098,547 | B2 * | 9/2024 | VanHoose | B28B 19/0053 |
| 12,247,391 | B2 * | 3/2025 | Neill | E04B 1/34853 |
| 2003/0014939 | A1 * | 1/2003 | DeWall | H02G 3/126 52/27 |
| 2003/0102421 | A1 * | 6/2003 | Mertens | E04G 13/04 249/33 |
| 2003/0233798 | A1 * | 12/2003 | Berkey | E04C 5/08 52/223.6 |

(Continued)

*Primary Examiner* — Brian E Glessner
*Assistant Examiner* — Daniel J Kenny
(74) *Attorney, Agent, or Firm* — Sheppard Mullin Richter & Hampton LLP

(57) ABSTRACT

In general, one aspect disclosed features a concrete-fillable prefabricated cartridge for constructing a structural concrete building, the concrete-fillable prefabricated cartridge comprising: an inner wall frame; a removable form attached to an outer portion of the inner wall frame such that liquid concrete may be poured into a cavity defined by the inner wall frame and the removable form; and one or more reinforcement bars disposed within the concrete-fillable form.

8 Claims, 14 Drawing Sheets

(56) References Cited

U.S. PATENT DOCUMENTS

| | | | | |
|---|---|---|---|---|
| 2009/0218474 | A1* | 9/2009 | Bowman | E04B 2/8611 249/18 |
| 2011/0282633 | A1* | 11/2011 | Bui | E04B 1/165 52/781.5 |
| 2015/0059275 | A1* | 3/2015 | Nanayakkara | E04B 1/2403 52/348 |
| 2016/0122996 | A1* | 5/2016 | Timberlake | E04B 1/167 52/742.14 |

* cited by examiner

CONCRETE-FILLABLE PREFABRICATED CARTRIDGES FOR CONSTRUCTING STRUCTURAL CONCRETE BUILDINGS AND CONSTRUCTION METHODS THEREFOR

CROSS REFERENCE TO RELATED APPLICATIONS

The present application claims priority to U.S. Provisional Patent Application No. 63/354,546, filed Jun. 22, 2022, entitled "CONCRETE-FILLABLE PREFABRICATED CARTRIDGES FOR CONSTRUCTING STRUCTURAL CONCRETE BUILDINGS AND CONSTRUCTION METHODS THEREFOR," the disclosure thereof is incorporated by reference herein in its entirety.

DESCRIPTION OF RELATED ART

The disclosed technology relates generally to the construction of buildings, and more particularly some embodiments relate to the use of concrete in in such construction.

SUMMARY

Embodiments of the disclosed technology provide concrete-fillable prefabricated cartridges that allow for quick and easy construction of structural concrete buildings such as homes and offices. Each cartridge may be customized for one of the rooms of the building. For example, these customized cartridges may include bedroom cartridges, kitchen cartridges, and living room cartridges. Each cartridge may include appropriate systems, appliances, and/or furnishings. For example, a kitchen cartridge may include electrical and plumbing systems, as well as one or more kitchen appliances. A bedroom cartridge may include electrical systems and closets. The cartridges may include other building features, for example including waterproof sheeting, waterproof interior form board shear wall, drywall, framing, and insulation.

The cartridges may include an inner wall frame and a removable form attached to an outer portion of the inner wall frame such that liquid concrete may be poured into a cavity defined by the two. Reinforcement bars may be disposed within the concrete-fillable form to increase the strength of the resulting structure. The cartridges may be arranged on a slab foundation and connected to each other and the slab foundation before filling the cartridges with liquid concrete. After the concrete is set, the outer forms may be removed. A roof may be attached to the cartridges to complete the structure.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

The figures are not exhaustive and do not limit the present disclosure to the precise form disclosed.

DETAILED DESCRIPTION

The disclosed embodiments provide concrete-fillable prefabricated cartridges for constructing structural concrete buildings and methods for constructing the buildings using the cartridges. But while the cartridges and methods are described as using concrete, it should be understood that other suitable materials may be used in place of concrete.

These disclosed prefabricated cartridges may include prefinished programmatic parts for kitchens, baths, living rooms, bedrooms, offices, closets, mechanical rooms, and similar rooms. The prefabricated cartridges may also include prefinished cabinets, fixtures, lighting, electrical, plumbing, mechanical systems, and similar building systems. The walls of the cartridges may include integrated formwork and reinforcing that allow for the pouring of concrete into the formwork in place after the cartridges are arranged at the building site, for example on an on-site slab foundation.

The programmatic cartridges may provide formwork for the structural walls of a building and may allow for the delivery of prefabricated bathrooms, kitchens, living room walls, bedroom walls, stair modules, office walls and other program elements. The programmatic cartridges may allow for fast construction of homes or other buildings like offices, medical facilities, and similar buildings. The disclosed cartridges and construction processes are ideal for disaster relief buildings that necessitate resilient structures to resist destruction from future disasters such as storms and earthquakes. The disclosed cartridges and construction processes are also ideal for regions of the world that generally build with concrete.

In some embodiments, the construction process may go as follows.

1. Cast slab on site and let cure;
2. Provide reinforcing access at slab perimeter;
3. Arrange the lightweight unfilled cartridges on the slab per the floor plan requirements;
4. Tie the rebar or reinforcing of the slab with the cartridge rebar through access holes in the prefabricated formwork;
5. pour concrete into the formwork and let cure; and
6. Strip the exterior form boards from the cartridges to reveal structural concrete wall exterior.

Prefabricated formwork with reinforcing may be included for infill walls between cartridges and roof slabs if concrete roofs and walls are desired. The cartridges may be installed on slabs on grade, podiums, or any other foundation where applicable.

The modular unfilled cartridges, since they are lightweight, are easily transportable, and easy to lift and move with forklifts or small cranes.

The modular unfilled cartridges may be efficiently sized to fit in shipping containers, on flat racks, or on flat beds. Cartridges sufficient to build a whole house may be packed in one 40' long shipping container, for example as described below.

Figure 1B:
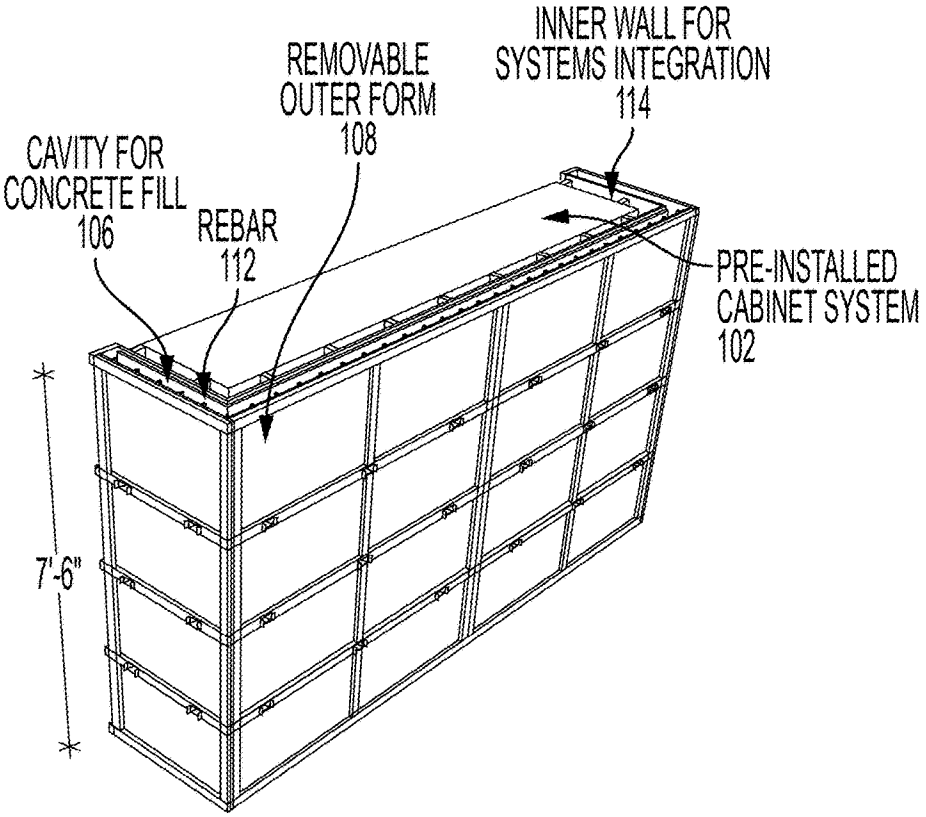
FIG. 1B is an outer perspective view of the bedroom cartridge of FIG. 1A according to some embodiments of the disclosed technologies.
Figure 1A:
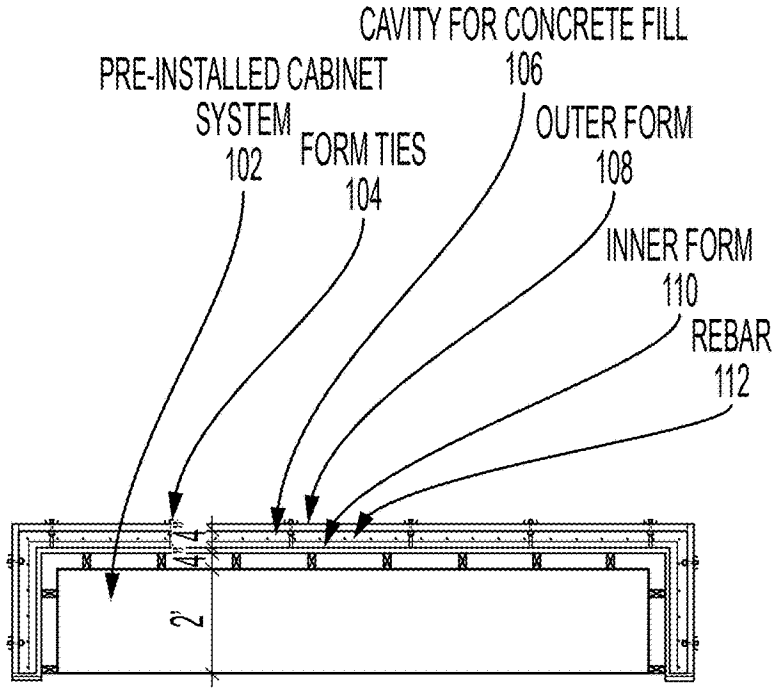
FIG. 1A is a plan view of an unfilled prefabricated concrete-fillable cartridge for a bedroom according to some embodiments of the disclosed technologies.
Figure 1C:
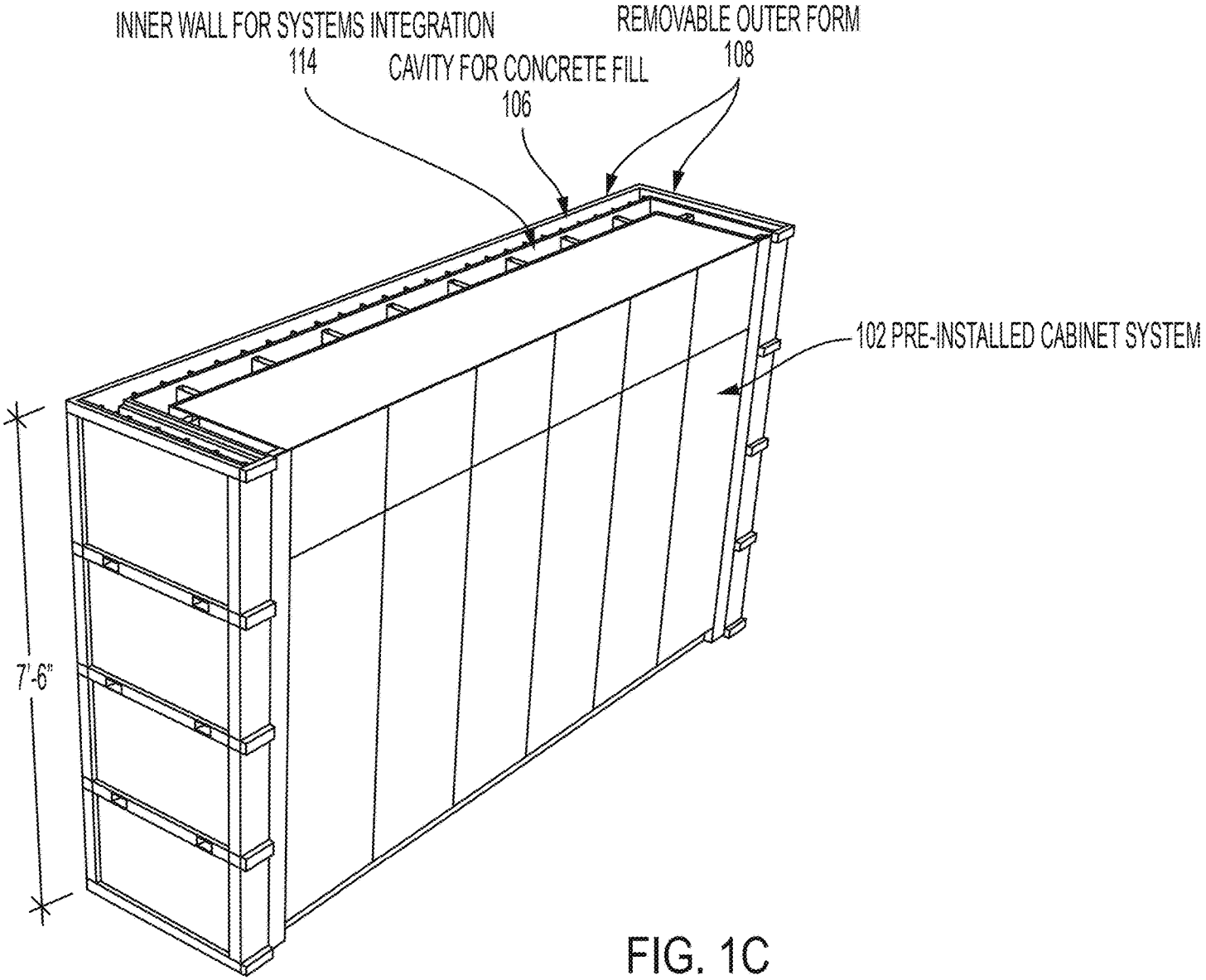
FIG. 1C is an inner perspective view of the bedroom cartridge of FIG. 1A according to some embodiments of the disclosed technologies.

FIG. 1A is a plan view of an unfilled prefabricated concrete-fillable cartridge 03 for a bedroom according to some embodiments of the disclosed technologies. FIG. 1B is an outer perspective view of the bedroom cartridge 03 according to some embodiments of the disclosed technologies. FIG. 1C is an inner perspective view of the bedroom cartridge 03 according to some embodiments of the disclosed technologies. Referring to FIGS. 1A,B,C, the bedroom cartridge 03 may include an inner wall 114. The inner wall 114 may include one or more building systems.

The bedroom cartridge 03 may include a removable outer form 108. In some embodiments, the inner wall 114 and the removable outer form 108 may define a cavity 106 configured to receive liquid concrete.

In some embodiments, the bedroom cartridge 03 may also include an inner form 110. In these embodiments, the inner form 110 and the removable outer form 108 may define a cavity 106 configured to receive liquid concrete.

In some embodiments, the cavity 106 may include reinforcement 112 about which the concrete may be poured. For example, the reinforcement may be rebar.

The outer form may be secured to the inner form 110, the inner wall 114, or both, by form ties 104. The outer form 108 may be removed by removing the form ties 104.

In some embodiments, the bedroom cartridge 03 may include a building component. In the example of FIGS. 1A,B,C, the building component is a pre-installed cabinet system 102.

FIGS. 1A,B,C, provide example dimensions of the bedroom cartridge 03 according to some embodiments. However, other embodiments may feature other dimensions.

Figure 2B:
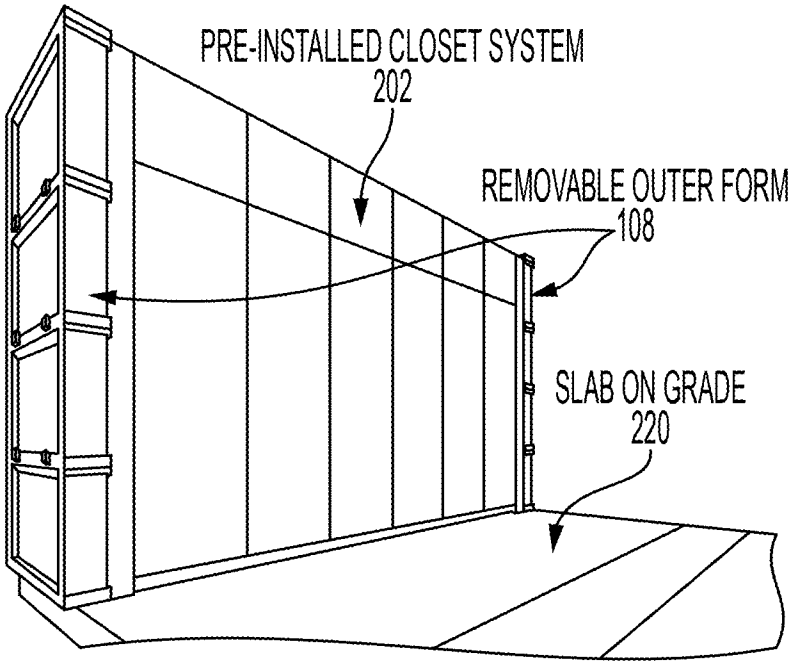
FIG. 2B is an inner perspective view of the cartridge of FIG. 2A according to some embodiments of the disclosed technologies.
Figure 2A:
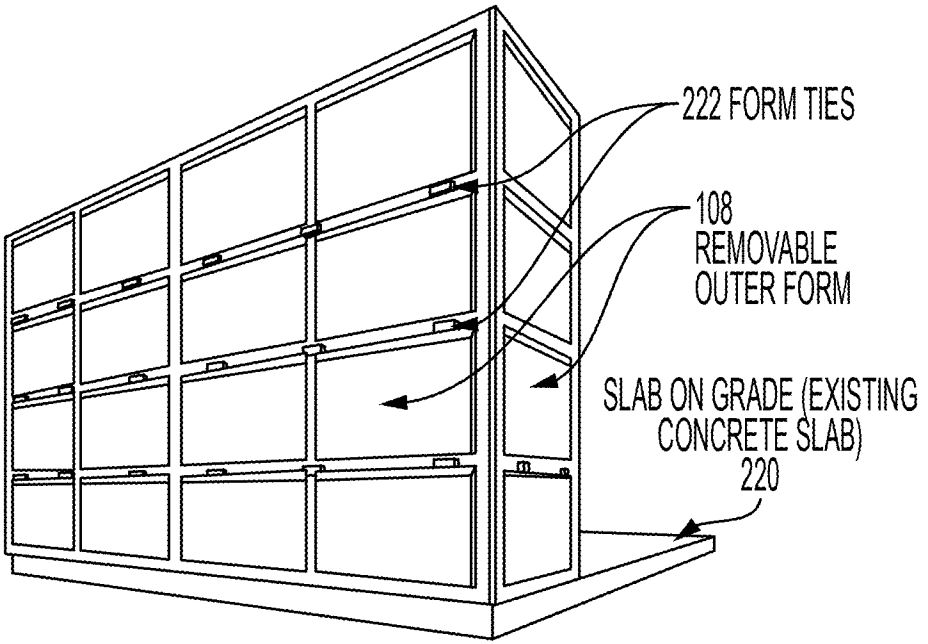
FIG. 2A is an outer perspective view of an unfilled prefabricated concrete-fillable cartridge according to some embodiments of the disclosed technologies.

FIG. 2A is an outer perspective view of an unfilled prefabricated concrete-fillable cartridge according to some embodiments of the disclosed technologies. FIG. 2B is an inner perspective view of the cartridge of FIG. 2A according to some embodiments of the disclosed technologies. Referring to FIGS. 2A,B the cartridge may include a removable outer form 108 secured by removable form ties 222. The cartridge may also include a pre-installed closet system 202. As shown in FIGS. 2A,B the cartridge may be disposed upon a slab on grade 220.

Figure 3B:
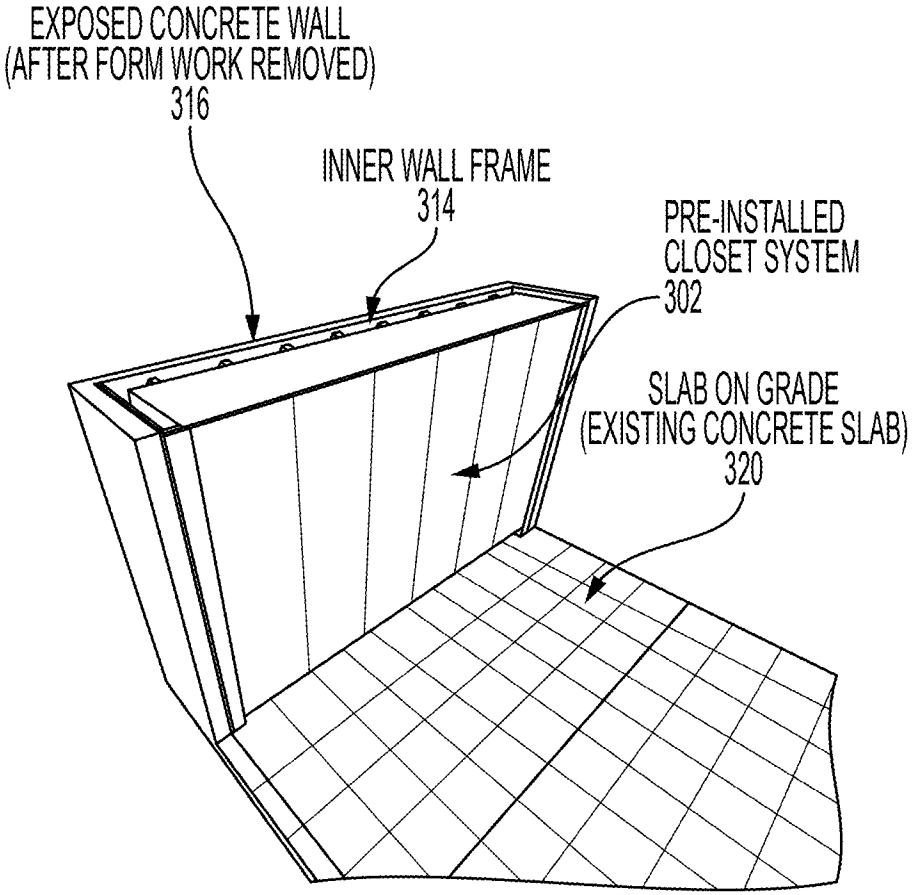
FIG. 3B is an inner perspective view of the cartridge of FIG. 3A according to some embodiments of the disclosed technologies.
Figure 3A:
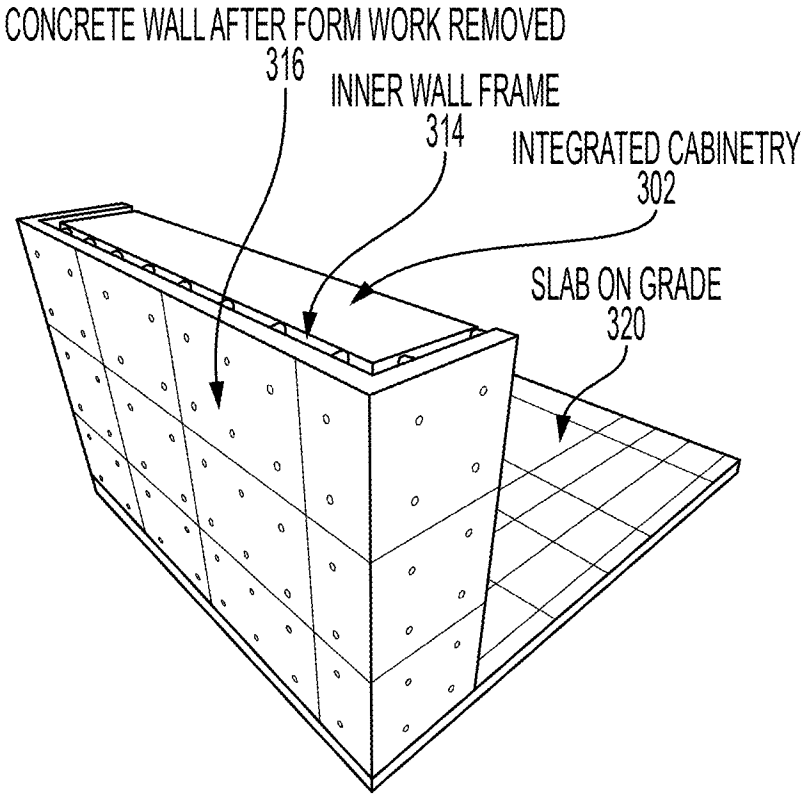
FIG. 3A is an outer perspective view of a prefabricated cartridge after filling the cartridge with concrete, allowing the concrete to cure, and removing the outer form according to some embodiments of the disclosed technologies.

FIG. 3A is an outer perspective view of a prefabricated cartridge after filling the cartridge with concrete, allowing the concrete to cure, and removing the outer form according to some embodiments of the disclosed technologies. FIG. 3B is an inner perspective view of the cartridge of FIG. 3A according to some embodiments of the disclosed technologies. Referring to FIGS. 3A,B the cartridge may include may include an inner wall 314. The inner wall 314 may include one or more building systems.

The cartridge may include a building component. In the example of FIGS. 3A,B, the cartridge is a pre-installed closet system 302. As shown in FIGS. 3A,B the cartridge may be disposed upon a slab on grade 220. With the outer form removed, the exposed concrete wall is visible in FIGS. 3A,B.

In the examples of FIGS. 1A,B,C, 2A,B, and 3A,B, the concrete wall may enclose a cartridge on three sides. But in other embodiments, the concrete wall may enclose the cartridge on fewer than three sides. These embodiments allow multiple cartridges to be ganged together to form one double-length wall. One such embodiment is depicted in FIG. 4.

Figure 4:
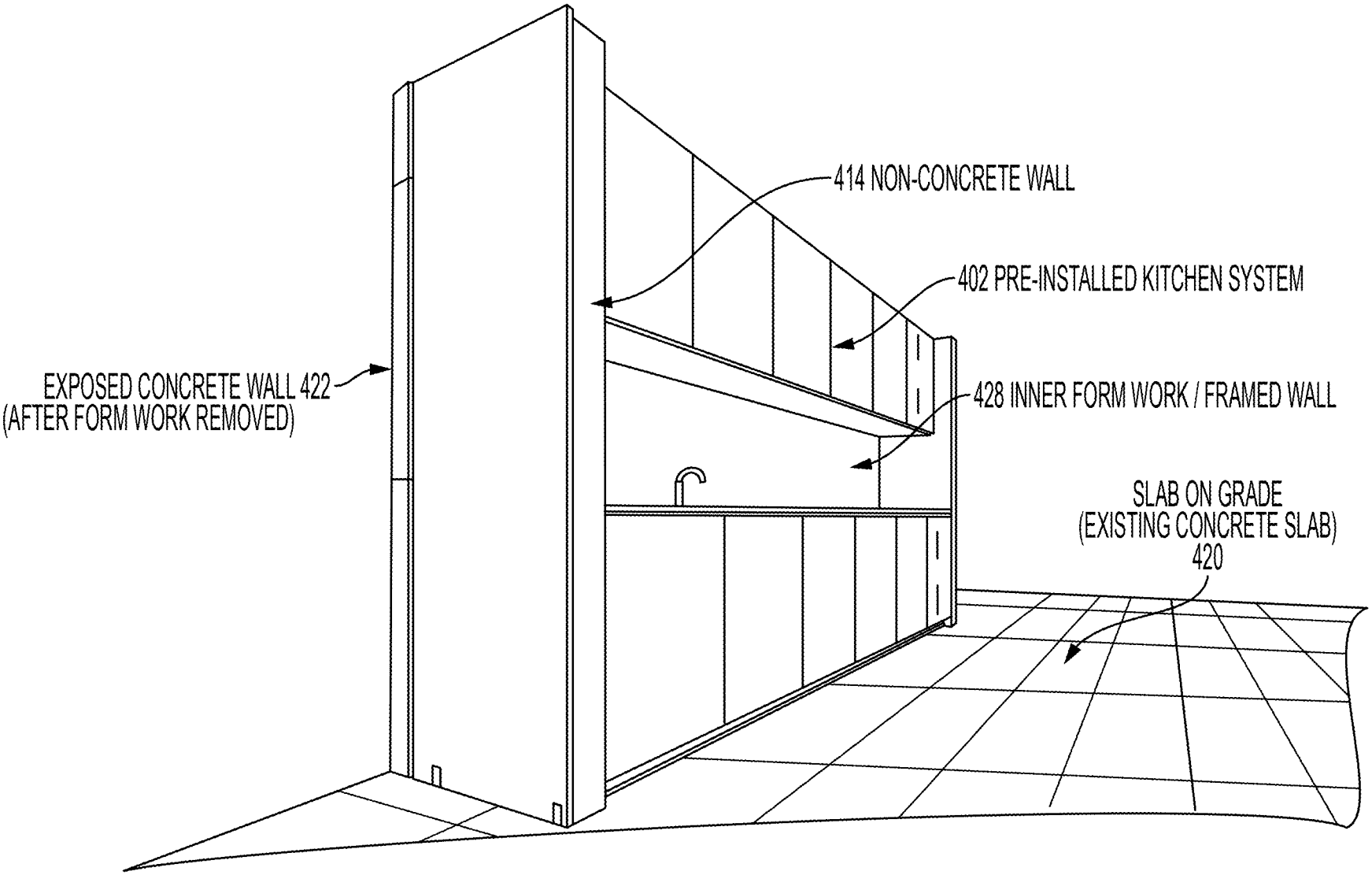
FIG. 4 is a perspective view of a prefabricated kitchen cartridge after filling the cartridge with concrete, allowing the concrete to cure, and removing the outer form according to some embodiments of the disclosed technologies.

FIG. 4 is a perspective view of a prefabricated kitchen cartridge after filling the cartridge with concrete, allowing the concrete to cure, and removing the outer form according to some embodiments of the disclosed technologies. Referring to FIG. 4, the resulting concrete wall 422 encloses the kitchen cartridge on only one side. The concrete wall 422 may be attached to an inner form work/framed wall 428.

The kitchen cartridge may include may include an inner wall 418, which may be made from a material other than concrete. The inner wall 418 may include one or more building systems.

The kitchen cartridge may include a building component. In the example of FIG. 4, the kitchen cartridge may include a pre-installed kitchen system 402. As shown in FIG. 4, the kitchen cartridge may be disposed upon a slab on grade 420. With the outer form removed, the exposed concrete wall is visible in FIGS. 2A,B.

Figure 5:
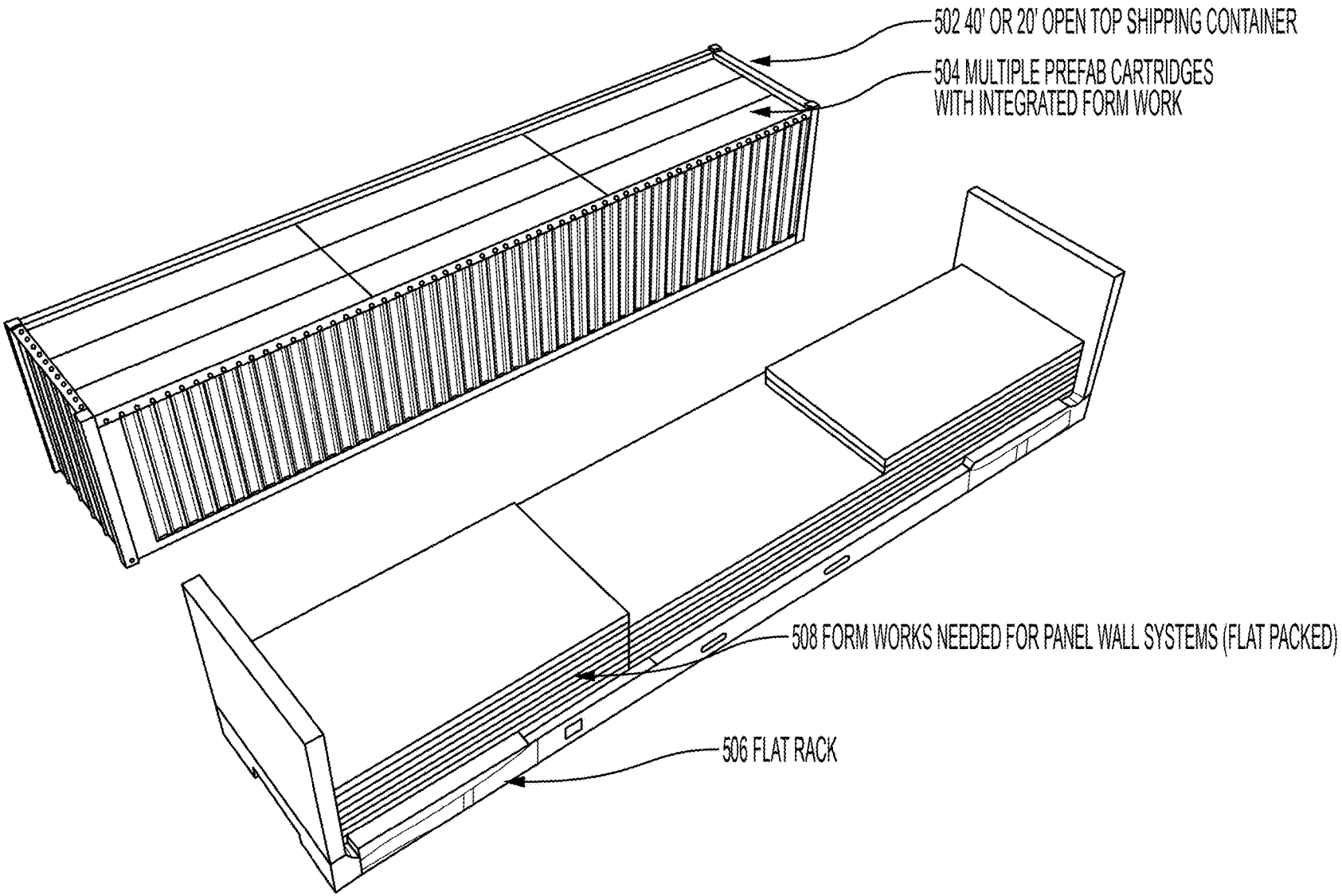
FIG. 5 depicts multiple pre-fabricated cartridges and panelized wall forms as packed for shipping according to some embodiments of the disclosed technologies.

FIG. 5 depicts multiple pre-fabricated cartridges and panelized wall forms as packed for shipping according to some embodiments of the disclosed technologies. Referring to FIG. 5, multiple pre-fabricated cartridges with integrated form work 504 are shown packed in an open-top shipping container 502. The size of the shipping container 502 may be selected according to the number and sizes of the cartridges 504 to be shipped. For example, the shipping container 502 may be 20' or 40' long. Also shown in FIG. 5 are multiple panelized wall forms 508 for panelized wall systems shown flat-packed on a flat rack 506. Other shipping containers and packing methods may be used, as will be apparent to one skilled in the relevant art.

Figure 6:
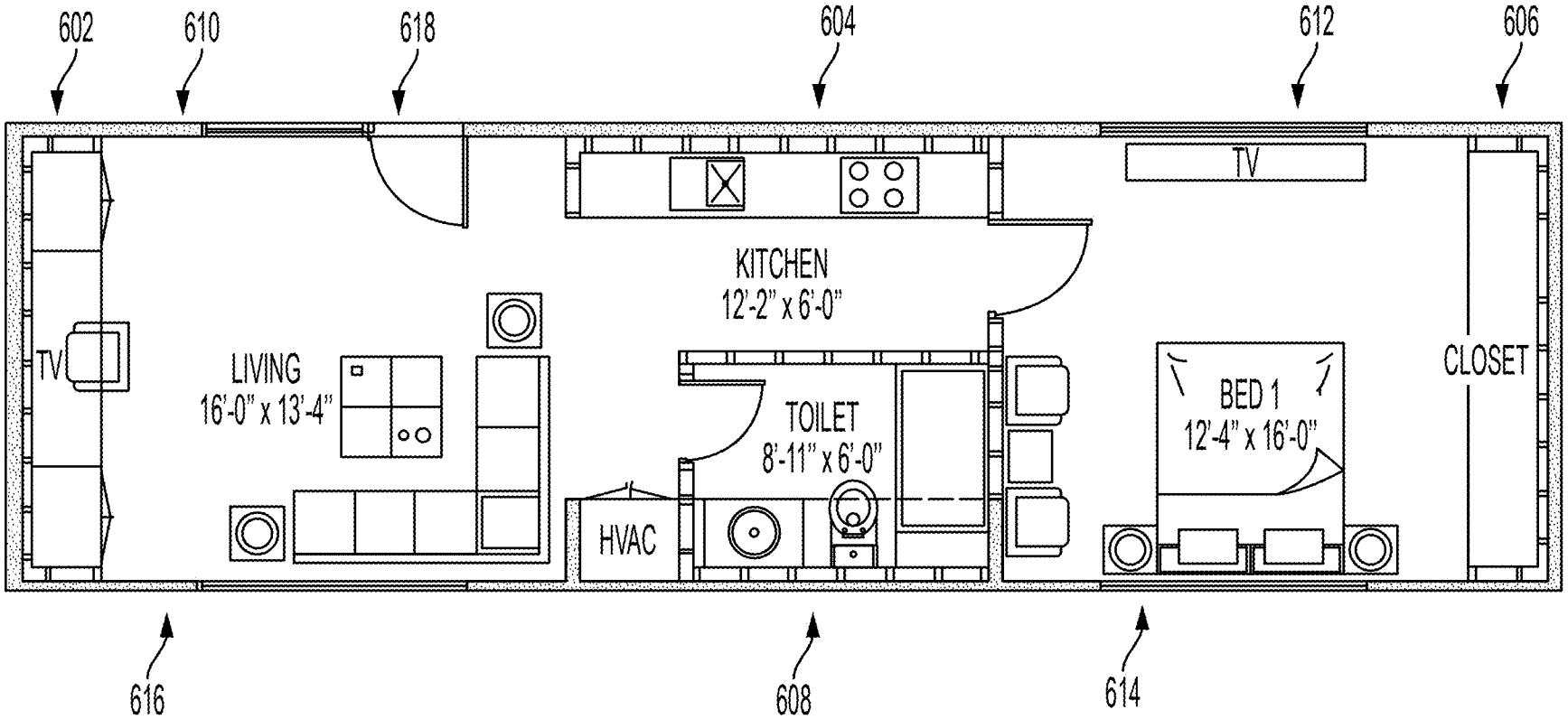
FIG. 6 is a plan view of a house constructed using the disclosed cartridges according to some embodiments of the disclosed technologies.

FIG. 6 is a plan view of a house constructed using the disclosed cartridges according to some embodiments of the disclosed technologies. Multiple possible plan arrangements may be made with the disclosed cartridges. Multiple floor levels may be constructed by stacking the cartridges. In the example of FIG. 6, the house includes multiple cartridges.

The cartridges include a living room cartridge 602, a kitchen cartridge 604, a bathroom cartridge 606, and a bedroom cartridge 608.

The house of FIG. 6 also includes multiple panelized walls connecting the cartridges. As with the cartridges, the panelized walls may be delivered as panelized wall forms, placed on a slab, connected with one or more cartridges and/or one or more other panelized wall forms, and filled with concrete. The panelized walls may be used as exterior or interior walls, and may run perpendicular to and/or parallel to the cartridges. The panelized walls may incorporate windows and/or doors if desired. Other walls made of other materials may be incorporated into the house. In the example of FIG. 6, the house includes exterior panelized walls 610, 612, 614, and 616. In this example, all of the panelized walls include windows, and panelized wall 610 includes a door, at 618.

Figure 7:
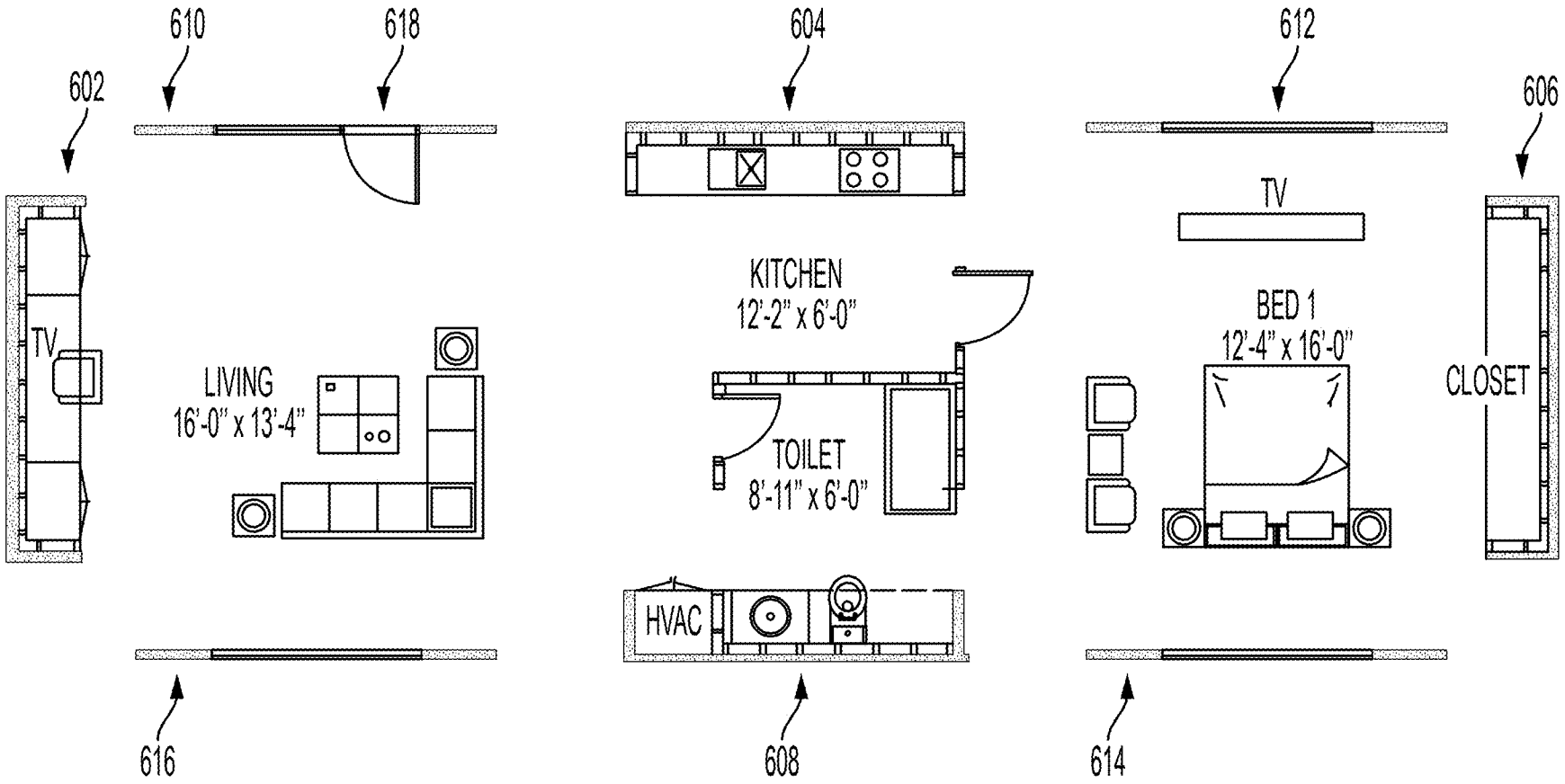
FIG. 7 is an exploded plan view of the house of FIG. 6.

FIG. 7 is an exploded plan view of the house of FIG. 6. FIGS. 6 and 7 provide example dimensions of the rooms of the house according to some embodiments. However, other embodiments may feature other dimensions.

Figure 8:
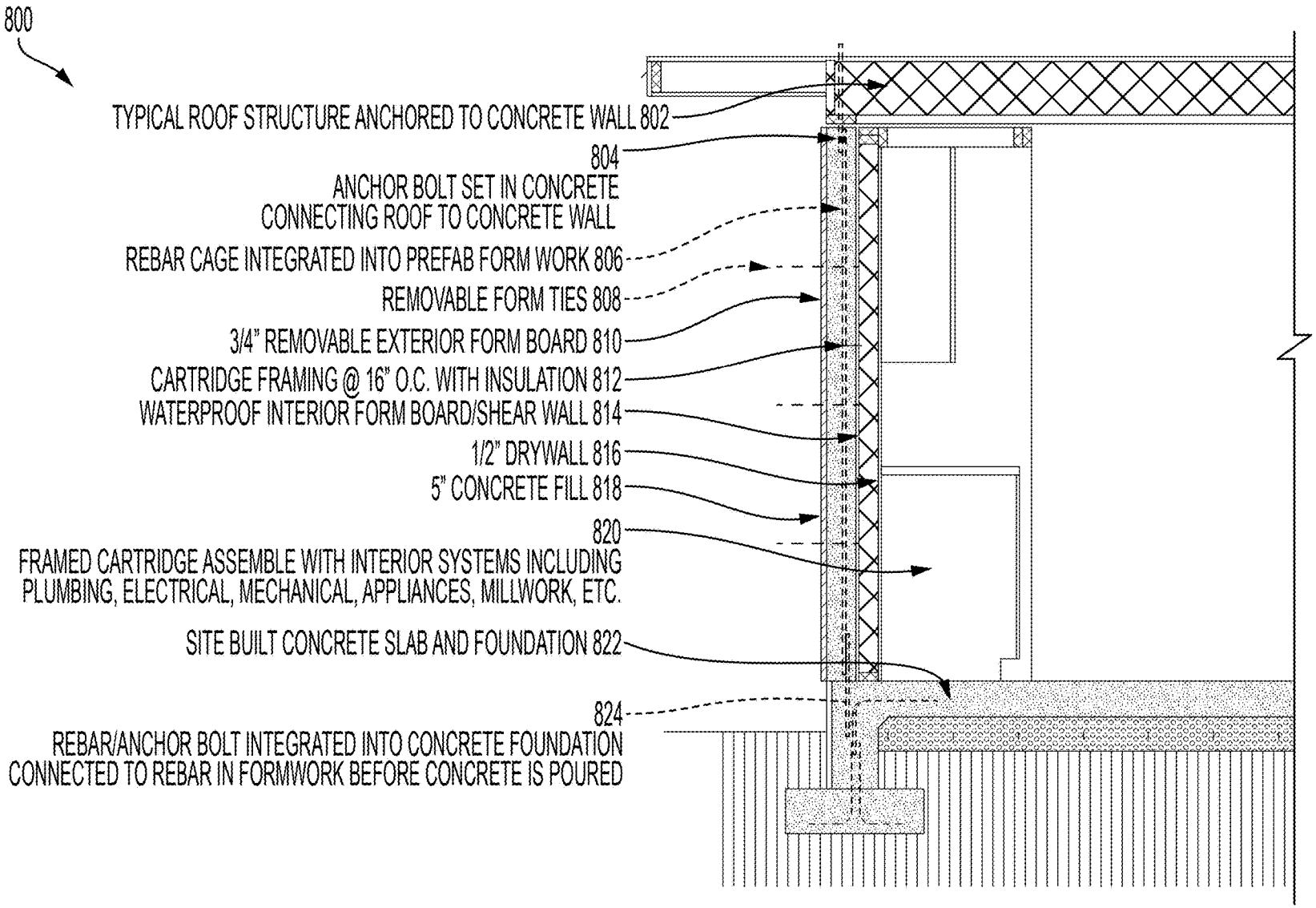
FIG. 8 illustrates an example wall section of the disclosed cartridges according to some embodiments of the disclosed technologies.

FIG. 8 illustrates an example wall section 800 of the disclosed cartridges according to some embodiments of the disclosed technologies. Referring to FIG. 8, the example wall section may include concrete fill 818 formed within a prefabricated form as disclosed herein. In this example the concrete fill 818 may be 5" thick. The example wall section 800 may include cartridge framing with insulation 812. The framing may be 16" on center.

The example wall section 800 may include a rear cage 806 integrated into the prefabricated form. The example wall section 800 may include removable form ties 808 and a removable form board 810 that may be removed after the concrete is set. In this example the removable form board 810 may be ¾" thick. The example wall section 800 may include a waterproof interior form board shear wall 814 and drywall 816. In this example the drywall 816 may be ½" thick. The example wall section 800 may include a framed cartridge assembly with interior systems 820. The systems may include plumbing, electrical, mechanical, appliances, millwork, and other building systems. The example wall section 800 may be disposed upon a site-built concrete slab and foundation 822, and may be integrated into the slab and foundation 822 by rebar and/or anchor bolts 824. For example, the rebar and/or anchor bolts 824 may be connected to rebar in the formwork before the concrete is poured into the formwork for the cartridge. The example wall section 800 may include an anchor bolt 804 set into the concrete in the top of the wall for anchoring a roof structure 802 to the wall.

Figure 9:
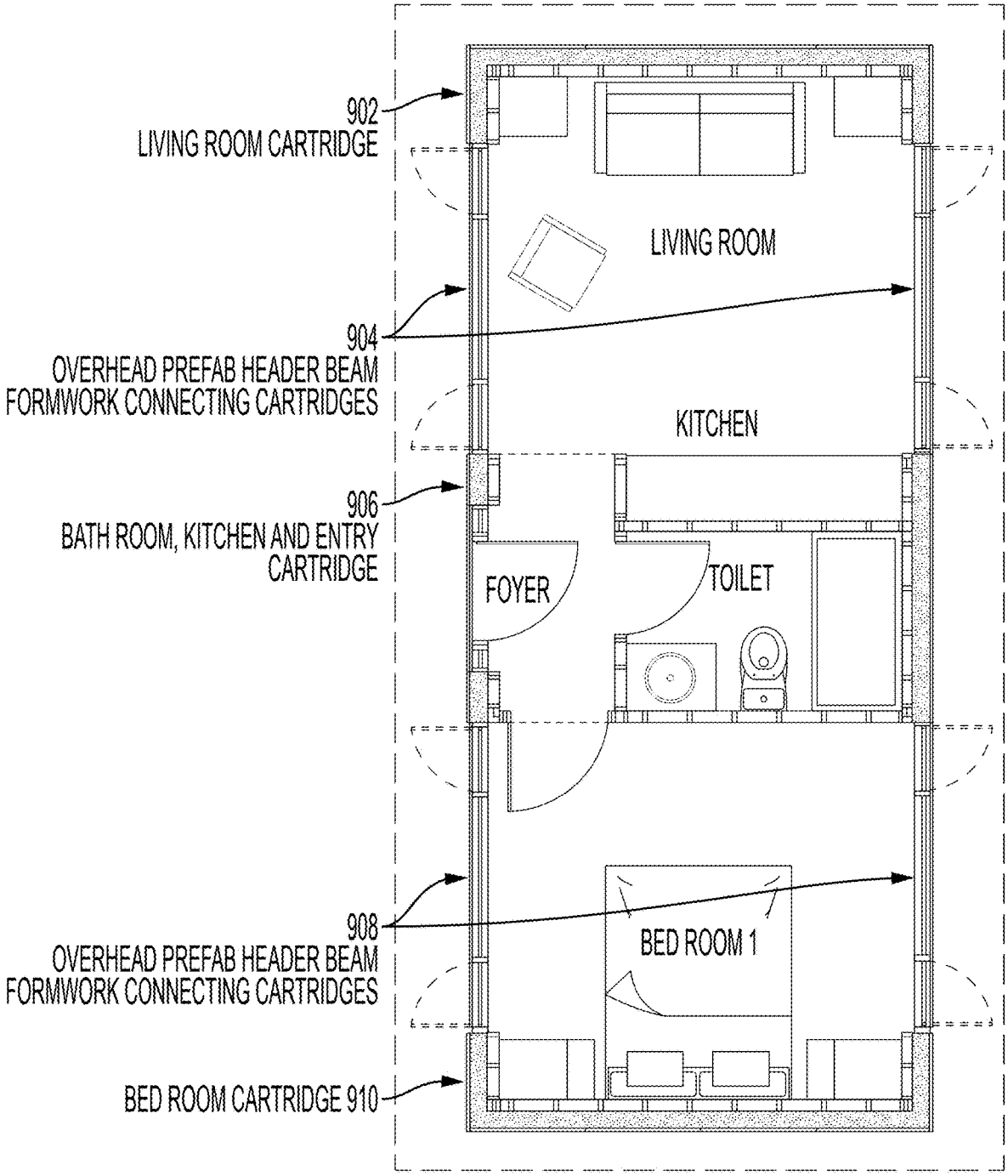
FIG. 9 is a plan view of a house constructed using the disclosed cartridges according to some embodiments of the disclosed technologies.

FIG. 9 is a plan view of a house constructed using the disclosed cartridges according to some embodiments of the disclosed technologies. In the example of FIG. 9, the house includes multiple cartridges. The cartridges include a living room cartridge 902, a bathroom, kitchen, and entry cartridge 906, and a bed room cartridge 910. The cartridges 902, 906, and 910 may be connected by overhead prefabricated beam formwork. In this example, the living room cartridge 902 and the bathroom, kitchen, and entry cartridge 906 are connected by overhead prefabricated beam formwork 904, and the bathroom, kitchen, and entry cartridge 906 and the bed room cartridge 910 are connected by overhead prefabricated beam formwork 908.

Figure 10:
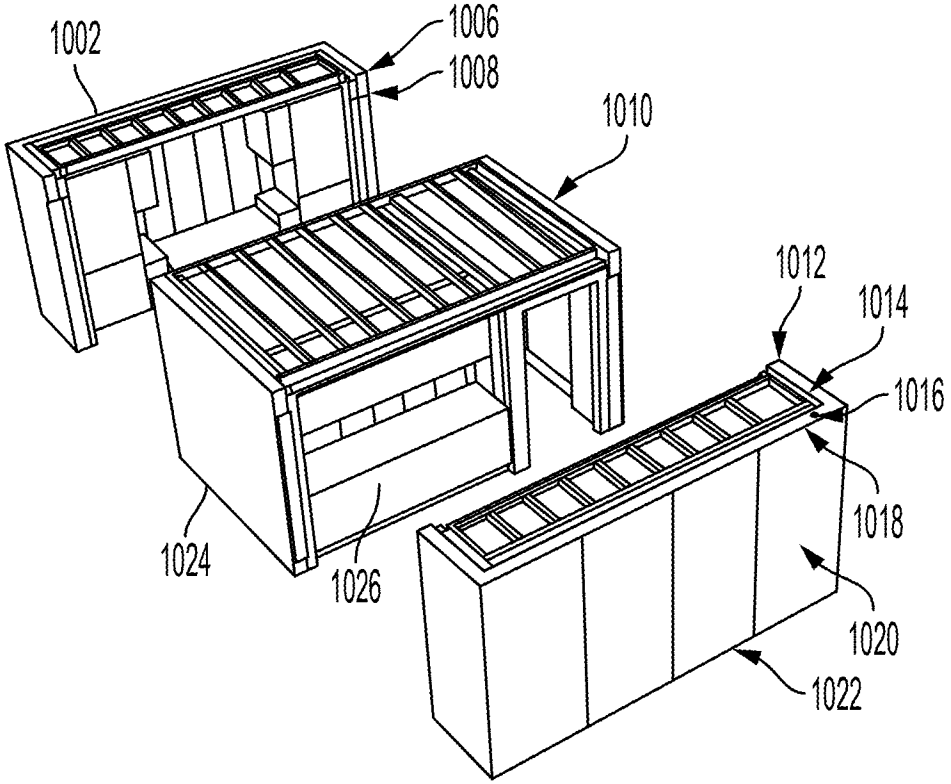
FIG. 10 is a perspective view of three of the disclosed cartridges according to some embodiments of the disclosed technology.

FIG. 10 is a perspective view of three of the disclosed cartridges according to some embodiments of the disclosed technology. In the example of FIG. 10, the cartridges include a bedroom cartridge 1002, a bathroom and kitchen cartridge 1010, and a living room cartridge 1012. The cartridges may include removable formwork with form ties 1020.

The cartridges may include interior walls 1014, which may include outer layers of waterproof sheeting, and may be insulated. The walls may include systems such as electrical, plumbing, mechanical, interior finishes, cabinetry, appliances, and other building systems.

The cartridges may include concrete fill 1006 around their perimeters and/or concrete fill with integrated rebar 1018. Formwork 1008 between the cartridges may connect with overhead structural lintels and beams. The cartridges may include anchor bolts 1016 set into the concrete after the concrete is poured for structural attachment to a roof structure. The cartridges may include rebar 1022 for connection to a slab having integrated anchor bolts or rebar.

The bedroom cartridge 1002 may include closets and integrated furnishings, including a Murphy bed. The bathroom and kitchen cartridge 1010 may include integrated formwork for concrete on the two exterior walls. The bathroom portion may include plumbing, electrical, toilet, tub and vanity systems 1024. The kitchen portion may include cabinet, appliances, and fixtures 1026.

Figure 11:
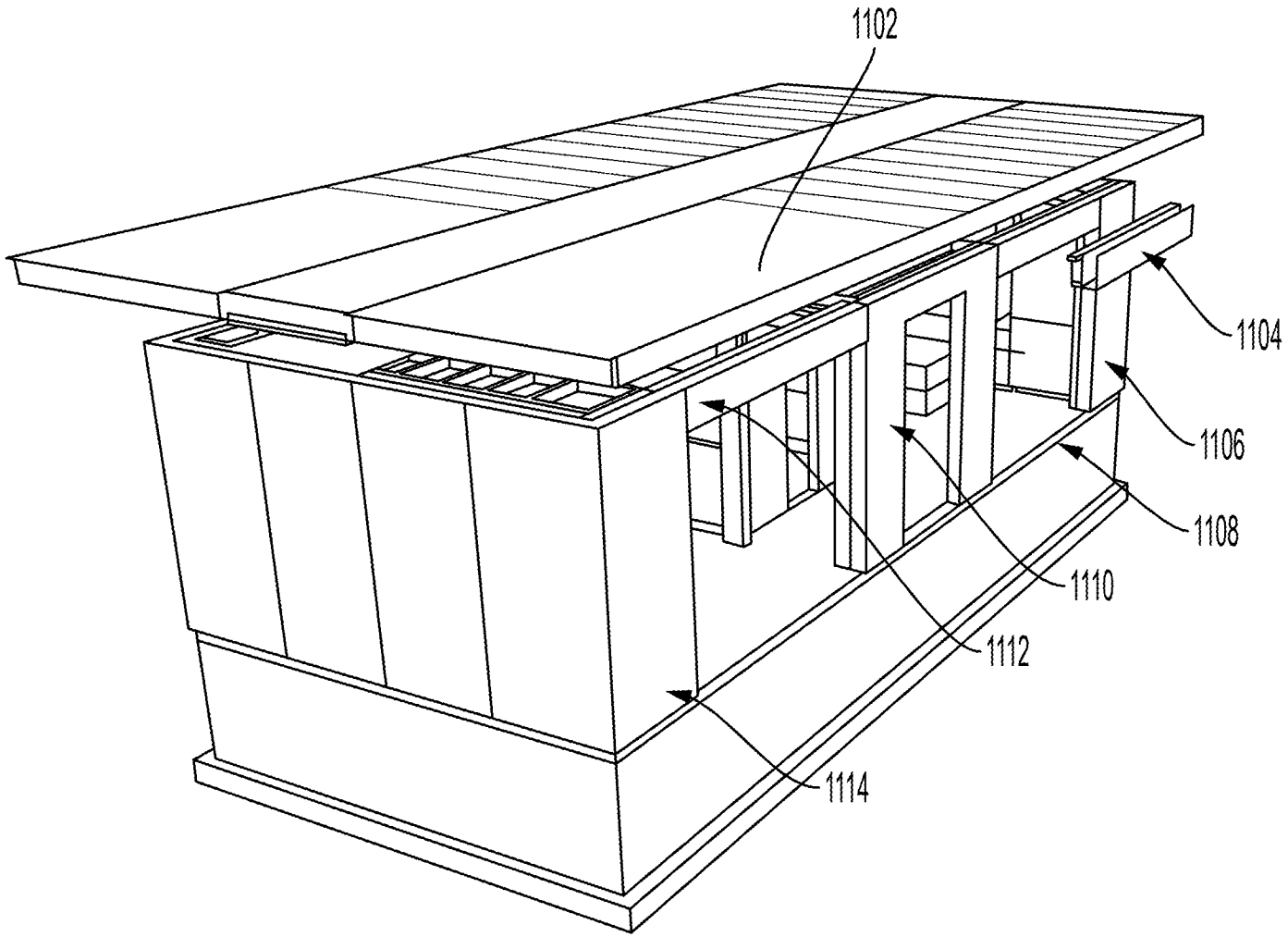
FIG. 11 is a perspective view of a house assembly using the disclosed cartridges according to some embodiments of the disclosed technology.

FIG. 11 is a perspective view of a house assembly using the disclosed cartridges according to some embodiments of the disclosed technology. In the example of FIG. 11, the cartridges include a bedroom cartridge 1106, a bathroom kitchen entry cartridge 1110, and a living room cartridge 1114.

The cartridges are arranged upon a slab and foundation 1108. The slab and foundation 1108 may have integrated fasteners to connect with the cartridges. The slab and foundation 1108 may be cast in place, fabricated using a fillable framework, or prefabricated.

A roof 1102 is structurally attached to the cartridges using integrated anchor bolts in the filled concrete walls. The roofs used may vary in design, i.e. trusses, joist, and similar features.

The house assembly may include lintel formwork 1104, 1112 that connects the cartridges, unifying the entire structure. For example, the lintel formwork may be placed over window and door openings. The lintel formwork may include integrated reinforcing such as rebar. The lintel formwork may be installed before the concrete pour, creating a bond beam.

Figure 12:
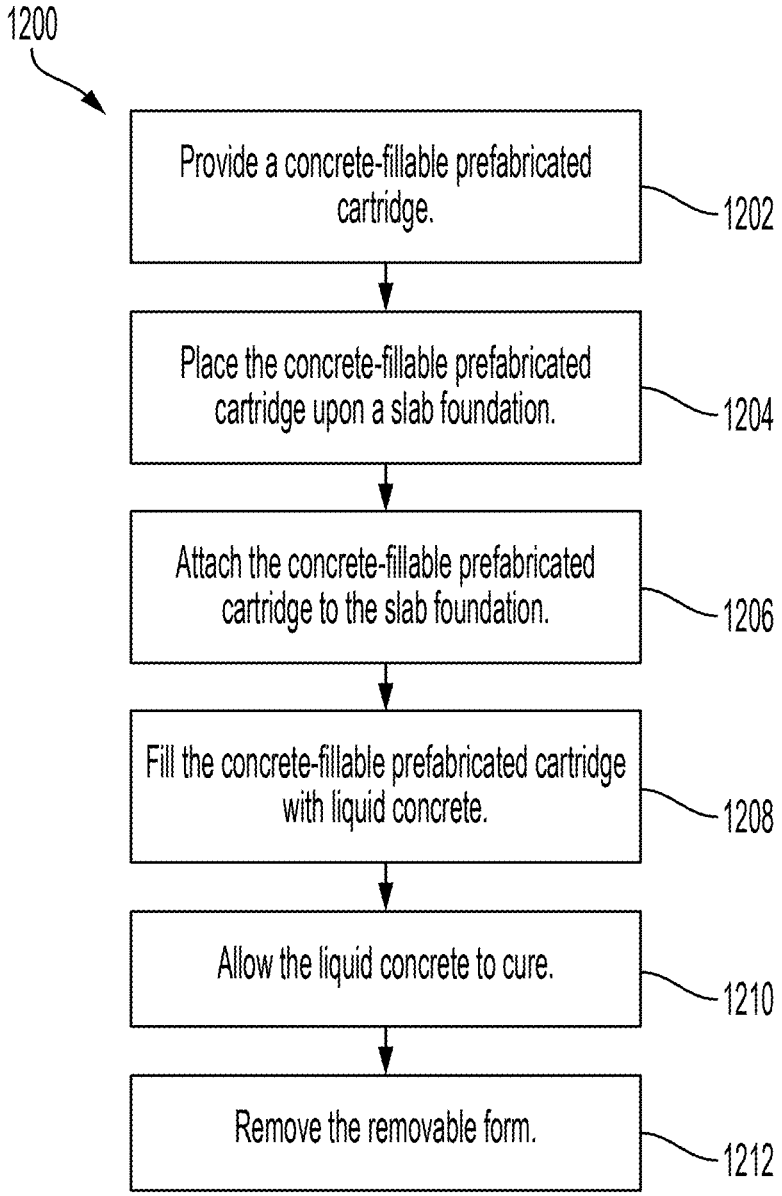
FIG. 12 is a flowchart illustrating a process for constructing structural concrete buildings using the disclosed concrete-fillable prefabricated cartridges according to some embodiments of the disclosed technologies.

FIG. 12 is a flowchart illustrating a process 1200 for constructing structural concrete buildings using the disclosed concrete-fillable prefabricated cartridges according to some embodiments of the disclosed technologies. For example, the process 1200 may be employed to construct the house of FIGS. 6 and 7.

The elements of the process 1200 are presented in one arrangement. However, it should be understood that one or more elements of the process may be performed in a different order, in parallel, omitted entirely, and the like. Furthermore, the process 1200 may include other elements in addition to those presented.

Referring again to FIG. 12, the process 1200 may include providing a concrete-fillable prefabricated cartridge, at 1202. The concrete-fillable prefabricated cartridge may include an inner wall frame, a removable form attached to an outer portion of the inner wall frame such that liquid concrete may be poured into a cavity defined by the inner wall frame and the removable form, and one or more reinforcement bars dispose within the concrete-fillable form. The concrete-fillable prefabricated cartridge may include an interior building component attached to an inner portion of the inner wall frame. The concrete-fillable prefabricated cartridge may include one or more building systems disposed within the inner wall frame and connected to the interior building component. The interior building component may include a cabinet, a fixture, a lighting component, an electrical component, plumbing, and a mechanical system. Examples of the concrete-fillable prefabricated cartridge are shown in FIGS. 1A,B,C, 2A,B, 3A,B, and 4.

Referring again to FIG. 12, the process 1200 may include placing the concrete-fillable prefabricated cartridge upon a slab foundation, at 1204. The process 1200 may include attaching the concrete-fillable prefabricated cartridge to the slab foundation, at 1206. Examples of the concrete-fillable prefabricated cartridge upon a slab foundation are shown in FIGS. 2A,B, 3A,B, and 4.

Referring again to FIG. 12, the process 1200 may include filling the concrete-fillable prefabricated cartridge with liquid concrete, at 1208. The liquid concrete may be poured into the cavity created by the outer form. The process 1200 may include allowing the liquid concrete to cure, at 1210.

Referring again to FIG. 12, the process 1200 may include removing the removable form, at 1212. For example, referring again to FIG. 2A, the form ties 222 securing the removable outer form 108 to the inner form 110 and/or inner wall 114 may be removed to release the outer form 108, which may then be removed.

Figure 13:
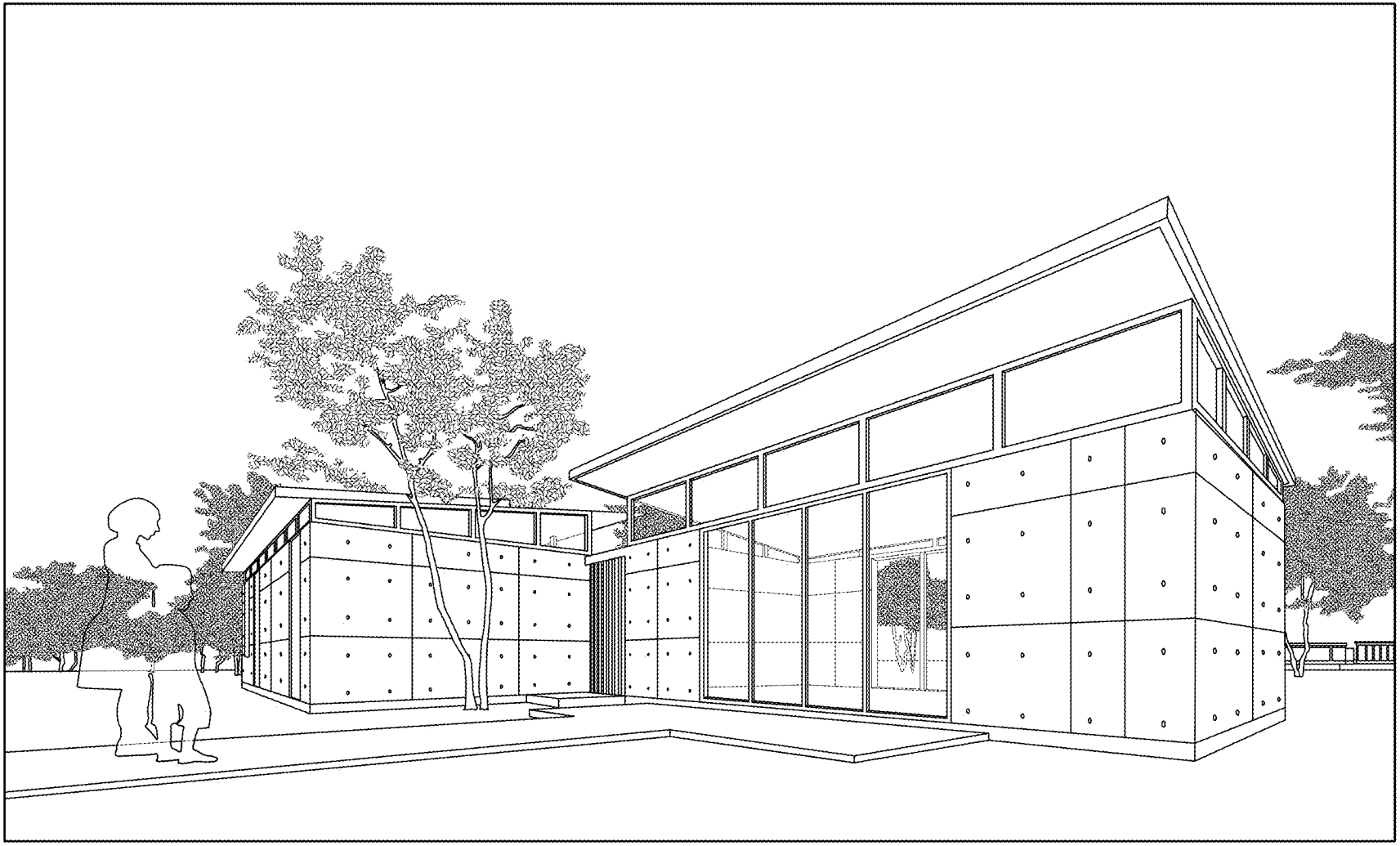
FIG. 13 is a perspective view of a completed house constructed using the disclosed technologies.

FIG. 13 is a perspective view of a completed house constructed using the disclosed technologies.

What is claimed is:

1. A process of constructing a structural concrete building using one or more concrete-fillable prefabricated cartridges, the process comprising:

providing a concrete-fillable prefabricated cartridge comprising:

an inner wall frame, a first removable form attached to an outer portion of the inner wall frame such that liquid concrete may be poured into a cavity defined by the inner wall frame and the first removable form, and one or more reinforcement bars disposed within the cavity of the concrete-fillable prefabricated cartridge, wherein the one or more reinforcement bars are one or more first reinforcement bars;

placing the concrete-fillable prefabricated cartridge upon a slab foundation;

filling the concrete-fillable prefabricated cartridge with liquid concrete;

allowing the liquid concrete to cure;

removing the first removable form;

providing a concrete-fillable prefabricated panelized wall cartridge comprising:

a panelized wall frame, a second removable form attached to an outer portion of the panelized wall frame such that liquid concrete may be poured into a wall cartridge cavity defined by the panelized wall frame and the second removable form, and one or more second reinforcement bars disposed within the cavity of the concrete-fillable prefabricated cartridge;

placing the concrete-fillable prefabricated panelized wall cartridge upon the slab foundation;

attaching the concrete-fillable prefabricated panelized wall cartridge to the slab foundation;

filling the concrete-fillable prefabricated panelized wall cartridge with liquid concrete;

allowing the liquid concrete to cure in the concrete-fillable prefabricated panelized wall cartridge; and removing the second removable form.

2. The process of claim 1, wherein:

the concrete-fillable prefabricated cartridge further comprises:

an interior building component attached to an inner portion of the inner wall frame, and one or more building systems disposed within the inner wall frame and connected to the interior building component; and the process further comprises: connecting the one or more building systems to one or more corresponding external building systems.

3. The process of claim 1, further comprising:

attaching the concrete-fillable prefabricated cartridge to the slab foundation.

4. The process of claim 1, wherein attaching the concrete-fillable prefabricated cartridge to the slab foundation comprises:

placing rebar into the concrete-fillable prefabricated cartridge; and connecting the one or more reinforcement bars disposed within the cavity to an anchor bolt or rebar set into the slab foundation before filling the concrete-fillable prefabricated cartridge with liquid concrete.

5. The process of claim 1, wherein the concrete-fillable prefabricated cartridge further is a first concrete-fillable prefabricated cartridge, the process further comprising:

attaching the first concrete-fillable prefabricated cartridge to a second concrete-fillable prefabricated cartridge.

6. The process of claim 1, wherein the concrete-fillable prefabricated cartridge further is a first concrete-fillable prefabricated cartridge, the process further comprising:

providing a lintel formwork and a second concrete-fillable prefabricated cartridge;

attaching the lintel formwork between the first concrete-fillable prefabricated cartridge to the second concrete-fillable prefabricated cartridge;

filling the lintel formwork with liquid concrete;

allowing the liquid concrete to cure; and removing the lintel formwork.

7. The process of claim 1, further comprising:

providing a roof structure; and attaching the roof structure to the concrete-fillable prefabricated cartridge.

8. The process of claim 7, wherein attaching the roof structure to the concrete-fillable prefabricated cartridge comprises:

setting an anchor bolt into the liquid concrete;

allowing the liquid concrete to cure; and attaching the roof structure to the anchor bolt after the allowing the liquid concrete to cure.

* * * * *